US007652655B2

(12) United States Patent
Kim

(10) Patent No.: US 7,652,655 B2
(45) Date of Patent: Jan. 26, 2010

(54) BACKLIGHT DRIVER CIRCUIT AND LIQUID CRYSTAL DISPLAY DEVICE HAVING THE SAME

(75) Inventor: Tae-Soo Kim, Suwon-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 646 days.

(21) Appl. No.: 11/322,261

(22) Filed: Jan. 3, 2006

(65) Prior Publication Data

US 2006/0187181 A1 Aug. 24, 2006

(30) Foreign Application Priority Data

Feb. 22, 2005 (KR) ..... 10-2005-0014698

(51) Int. Cl.
*G09G 3/36* (2006.01)

(52) U.S. Cl. ..... 345/102; 345/100; 345/98; 345/204

(58) Field of Classification Search ..... 345/102
See application file for complete search history.

(56) References Cited

U.S. PATENT DOCUMENTS

| | | | | |
|---|---|---|---|---|
| 5,602,655 | A * | 2/1997 | Arakawa et al. | 358/501 |
| 5,673,059 | A * | 9/1997 | Zavracky et al. | 345/8 |
| 7,253,794 | B2 * | 8/2007 | Wood | 345/84 |
| 7,425,801 | B2 * | 9/2008 | Ozaki | 315/291 |
| 7,522,136 | B2 * | 4/2009 | Park et al. | 345/88 |

(Continued)

FOREIGN PATENT DOCUMENTS

| | | |
|---|---|---|
| CN | 1265506 | 9/2000 |

(Continued)

OTHER PUBLICATIONS

Korean Notice of Allowability corresponding to Korean Patent Application No. 10-2005-0014698, mailed on Jun. 8, 2007.

(Continued)

*Primary Examiner*—Richard Hjerpe
*Assistant Examiner*—Gregory J Tryder
(74) *Attorney, Agent, or Firm*—Robert E. Bushnell, Esq.

(57) ABSTRACT

In a backlight driver circuit and a liquid crystal display (LCD) device employing the same, separate forward driving currents are applied to red (R), green (G) and blue (B) backlights, respectively, thereby overcoming the problem of brightness variation resulting from forward voltage Vf variation in a light emitting diode (LED). The LCD includes: a backlight unit provided with R, G and B backlights for emitting light toward an LCD panel in sequence; and a backlight driver for supplying driving currents and pulse width modulation (PWM) signals to the backlight unit so as to control brightness and chromaticity of the R, G and B backlights. The backlight driver includes: a driving current generator for supplying R, G and B driving currents to the respective R, G and B backlights, and for causing the respective R, G and B backlights to emit light with predetermined brightness; and a PWM signal generator for supplying R, G and B PWM signals to the R, G and B backlights, respectively, so as to adjust the chromaticity of the light emitted from the R, G and B backlights, respectively.

19 Claims, 5 Drawing Sheets

U.S. PATENT DOCUMENTS

| | | | | |
|---|---|---|---|---|
| 2002/0084973 | A1 * | 7/2002 | Choi et al. | 345/102 |
| 2003/0178951 | A1 | 9/2003 | Park et al. | |
| 2006/0103612 | A1 * | 5/2006 | Ozaki | 345/83 |

FOREIGN PATENT DOCUMENTS

| | | |
|---|---|---|
| JP | 2000-206486 | 7/2000 |
| JP | 2000-214435 | 8/2000 |
| JP | 2002-111786 | 4/2002 |
| JP | 2003-107424 | 4/2003 |
| JP | 2004-029141 | 1/2004 |
| JP | 2004-309509 | 11/2004 |
| JP | 2004-341206 | 12/2004 |
| JP | 2005-017324 | 1/2005 |
| KR | 10-1999-0076777 | 10/1999 |
| KR | 2001-110683 | 9/2000 |
| KR | 2002-0084125 | 11/2002 |
| KR | 10-2004-0004649 | 1/2004 |
| KR | 10-2004-0042402 | 5/2004 |
| KR | 10-2004-0089381 | 10/2004 |
| WO | WO 2004090997 A1 * | 10/2004 |

OTHER PUBLICATIONS

Korean Office Action for Korean Patent Application No. 2005-0014698 issued on Aug. 2, 2006.

Korean Office Action for Korean Patent Application No. 2005-0014698 issued on Dec. 13, 2006.

*The Office Action* from the Japanese Patent Office issued in Applicant's corresponding Japanese Patent Application No. 2005-234809 dated Sep. 24, 2008.

Office action from the Patent Office of the People's Republic of China issued in corresponding Applicant's Chinese Patent Application No. 200410103347.5 dated Apr. 6, 2007.

Certificate of Patent from the Chinese Patent Office issued in corresponding Applicant's Chinese Patent Application No. 200410103347.5 dated Dec. 31, 2008 with Request for Entry of the Accompanying Document.

* cited by examiner

BACKLIGHT DRIVER CIRCUIT AND LIQUID CRYSTAL DISPLAY DEVICE HAVING THE SAME

CLAIM OF PRIORITY

This application makes reference to, incorporates the same herein, and claims all benefits accruing under 35 U.S.C. §119 from an application earlier filed in the Korean Intellectual Property Office on Feb. 22, 2005 and there duly assigned Ser. No. 2005-14698.

BACKGROUND OF THE INVENTION

1. Technical Field of the Invention

The present invention relates to a liquid crystal display (LCD) device, and more particularly, to a backlight driver circuit and an LCD device having the same, in which a forward driving current is applied to red (R), green (G), and blue (B) backlights, thereby improving brightness variation in response to a forward voltage Vf applied to a light emitting diode (LED).

2. Related Art

In general, a color liquid crystal display (LCD) device includes: an LCD panel having an upper substrate, a lower substrate, and a liquid crystal disposed between the upper and lower substrates; a driver circuit for driving the LCD panel; and a backlight for emitting light toward the LCD panel. Such an LCD device is classified as either a color filter LCD or a field sequential LCD according to the manner in which a color image is displayed.

In the color filter LCD, one pixel is divided into R, G and B sub-pixels. In this regard, R, G and B color filters are arranged on the R, G and B sub-pixels, respectively. Thus, light is emitted from one backlight to the R, G and B color filters through the liquid crystal, thereby displaying a color image.

In the field sequential LCD, R, G and B backlights are arranged on one pixel that is not divided into R, G and B sub-pixels, unlike the color filter LCD. In this regard, three primary lights of R, G and B are emitted from the R, G and B backlights, respectively, toward one pixel through the liquid crystal in a time-division manner, thereby utilizing persistence of vision to display a color image.

In the backlight driver circuit of the field sequential LCD, the same driving voltage of 4V is applied even though the R, G and B light emitting diodes are driven by different driving voltages Vf. In this regard, since the same driving voltage is supplied during three sub-frames corresponding to one frame for driving the R, G and B light emitting diodes, the driving voltage generator should generate the highest driving voltage among the driving voltages needed for the R, G and B light emitting diodes, and thus power consumption increases.

Furthermore, since the forward driving voltages supplied to the R, G and B light emitting diodes in each sub-frame vary with temperature, the brightness of each backlight also varies somewhat with temperature, thereby upsetting white balance.

SUMMARY OF THE INVENTION

The present invention relates to a field sequential liquid crystal display (LCD) device having a backlight driver circuit capable of supplying driving currents suitable for respective light emitting diodes regardless of temperature-dependant variation of a driving voltage of the light emitting diodes.

The present invention also provides a field sequential LCD device having a backlight driver circuit capable of supplying driving currents suitable for respective light emitting diodes, and of reducing power consumption.

The present invention also provides a filed sequential LCD device having a backlight driver circuit capable of supplying driving currents suitable for respective light emitting diodes, and of maximizing power efficiency.

The present invention also provides a field sequential LCD device having a backlight driver circuit capable of optimizing white balance using a pulse width modulation (PWM) value.

Additional features of the invention will be set forth in the description which follows and, in part, will be apparent from the description, or may be learned by practice of the invention According to an aspect of the present invention, an LCD device includes: an LCD panel having a plurality of pixels formed in a region where a plurality of scan lines intersect a plurality of data lines, the LCD panel displaying a predetermined image; a scan driver for supplying a scan signal to the plurality of scan lines so as to select pixels; a source driver for supplying a data signal to the pixels selected by the scan signal through the plurality of data lines; a backlight unit having R, G and B backlights for sequentially emitting light toward the LCD panel in one frame divided into at least two sub-frames; a backlight driver circuit for supplying R, G and B driving currents and R, G and B pulse width modulation (PWM) signals to the backlight unit, and for controlling the brightness and chromaticity of the R, G and B backlights; and a timing controller for controlling the scan driver, the source driver, and the backlight driver.

The backlight driver circuit includes: a driving current generator for supplying the R, G and B driving currents to the R, G and B backlights, respectively, so as to cause the respective R, G and B backlights to emit light with predetermined brightness; and a pulse width modulation (PWM) signal generator for supplying the R, G and B PWM signals to the R, G and B backlights so as to adjust the chromaticity of the light emitted from the R, G and B backlights.

The backlight driver circuit further includes an LED controller for supplying a control signal to the PWM signal generator so as to cause at least one of the R, G and B backlights to emit light.

According to another aspect of the present invention, a backlight driver circuit emits light toward an LCD panel so as to display an image on the basis of a scan signal of a scan driver and a data signal of a source driver. The backlight driver circuit includes: a backlight unit having R, G and B backlights sequentially emitting light toward the LCD panel in one frame divided into at least two sub-frames; a driving current generator for supplying R, G and B driving currents to the R, G and B backlights, respectively, so as to cause the R, G and B backlights to emit light with predetermined brightness; and a PWM signal generator for supplying R, G and B PWM signals to the R, G and B backlights so as to adjust the chromaticity of the light emitted from the R, G and B backlights.

The backlight driver circuit further includes an LED controller for supplying a control signal to the PWM signal generator so as to cause at least one of the R, G and B backlights to emit light.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, exemplary embodiments of the present invention will be described with reference to the accompanying drawings.

Figure 1:
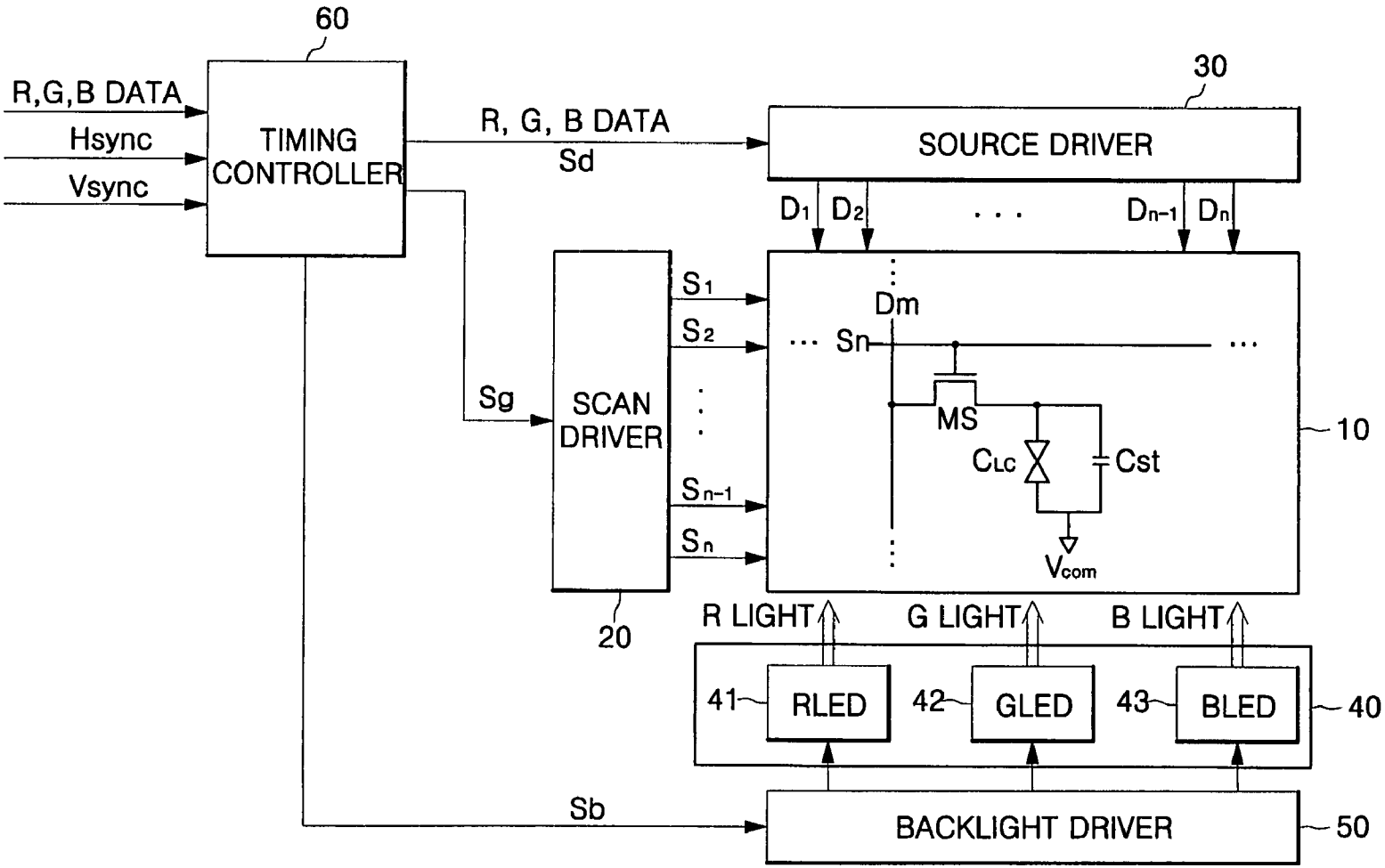
FIG. 1 is a block diagram of a field sequential liquid crystal display (LCD) device.

FIG. 1 is a block diagram of a field sequential liquid crystal display (LCD) device.

Referring to FIG. 1, the LCD device includes an LCD panel 10 having a lower substrate (not shown), an upper substrate (not shown), and a liquid crystal (not shown) sandwiched between the upper and lower substrates. The lower substrate is formed with a thin film transistor (TFT) array having a switching thin film transistor MS connected to a plurality of scan lines S1 thru Sn and a plurality of data lines D1 thru Dm, and the upper substrate is formed with a common electrode to supply a common voltage to a common line.

Furthermore, the LCD device comprises: a scan driver 20 for supplying a scan signal to the plurality of scan lines S1 thru Sn of the LCD panel 10; a source driver 30 for supplying R, G and B data signals to the plurality of data lines D1 thru Dm; a backlight unit 40 having R, G and B light emitting diodes (LEDs) for sequentially emitting three primary lights of R, G and B to the LCD panel 10; and a backlight driver circuit 50 for driving the backlight unit 40. Additionally, the LCD device includes a timing controller 60 for controlling the scan driver 20, the source driver 30, and the backlight driver 50.

The backlight unit 40 includes at least three LEDs such as an RLED 41, a GLED 42, and a BLED 43 for emitting the R, G and B lights, respectively; and a light guide plate (not shown) for guiding the R, G and B lights sequentially emitted from the RLED 41, the GLED 42, and the BLED 43, respectively, toward the liquid crystal of the LCD panel 10.

Typically, one frame driven at 60 Hz has a period of 16.7 ms (i.e., 1/60 s). In the field sequential LCD, one frame is divided into three sub-frames, and thus one sub-frame has a period of 5.56 ms (i.e., 1/180 s). This period corresponding to one sub-frame is so short that the human eyes cannot detect a field change. Consequently, a viewer merely recognizes a mixture of R, G and B colored lights in the period of 16.7 ms corresponding to one frame.

Thus, the field sequential LCD has a resolution three times higher than that of a color filter LCD having the same size of panel. Furthermore, since the field sequential LCD does not employ a color filter, it has enhanced optical efficiency. Also, the field sequential LCD has the same color reproduction as a cathode ray tube (CRT) display, and is capable of displaying a fast moving picture. However, the field sequential LCD requires a driving frequency at least three times higher than that of the color filter LCD, and thus it should have a fast operation characteristic.

To obtain the field sequential LCD having a fast operation characteristic, the liquid crystal should have a fast response time, and thus a switching time for turning the R, G and B backlights on/off should be shorted.

Figure 2:
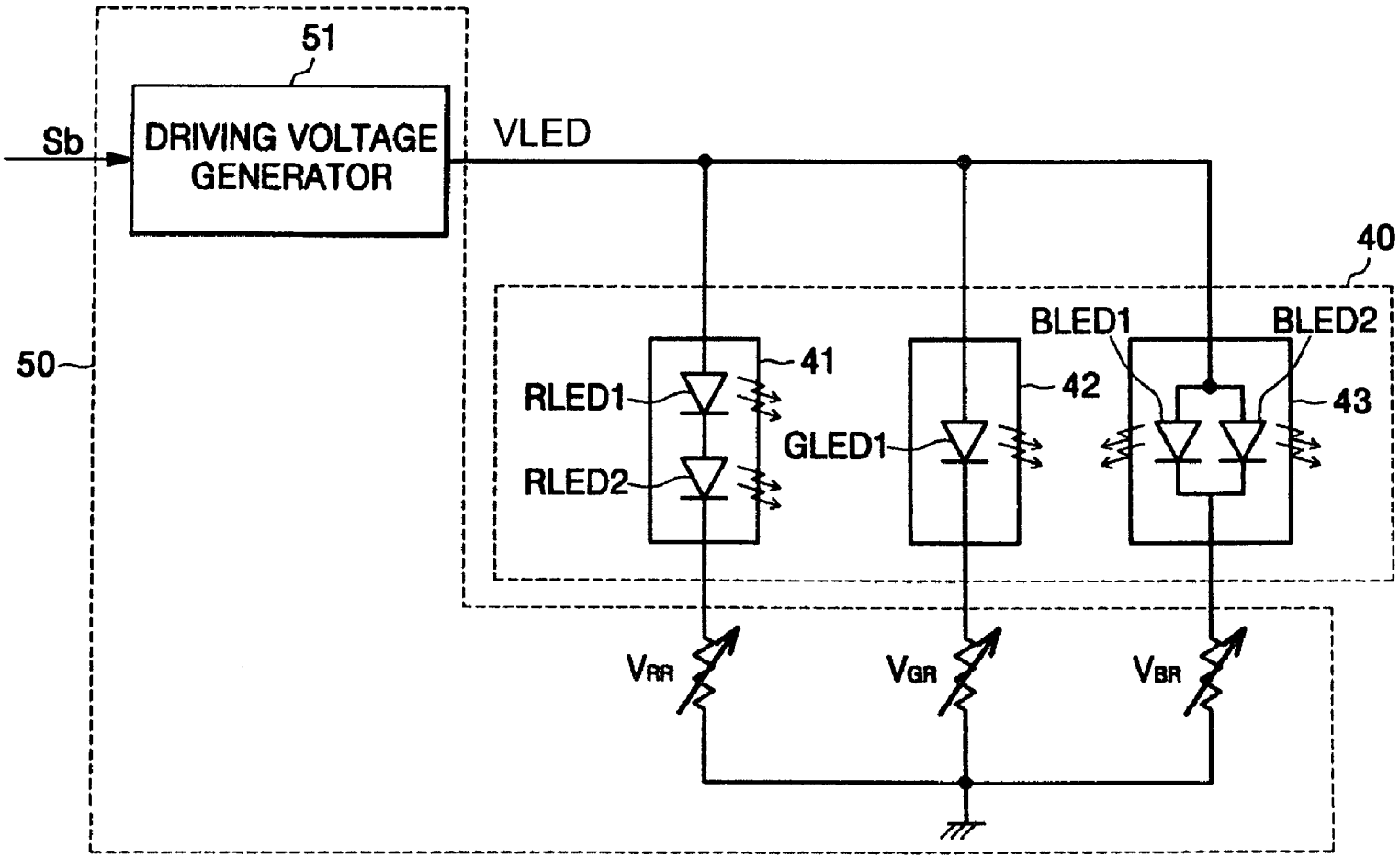
FIG. 2 is a block diagram of a backlight driver circuit employed in the field sequential LCD shown in FIG. 1.

FIG. 2 is a block diagram of a backlight driver circuit employed in the field sequential LCD.

Referring to FIG. 2, the backlight driver circuit 50 includes: the backlight unit 40 for sequentially emitting three primary lights of R, G, and B; and a driving voltage generator 51 for commonly supplying a driving voltage VLED to the R backlight 41, the G backlight 42, and the B backlight 43. The backlight driver circuit 50 has brightness adjusters VRR, VGR, and VBR connected in series with backlights 41, 42 and 43, respectively.

The backlight unit 40 includes the R backlight 41 for emitting red light, the G backlight 42 for emitting green light, and the B backlight 43 for emitting blue light. The R backlight 41 includes two R light emitting diodes RLED1 and RLED2 connected in series with each other for emitting red light. The G backlight 42 includes one G light emitting diode GLED1 for emitting green light. The B backlight 43 includes two B light emitting diodes BLED1 and BLED2 connected in parallel with each other for emitting blue light.

The driving voltage generator 51 generates the driving voltage VLED and supplies it to the R, G and B backlights 41, 42 and 43, respectively. In this regard, the R backlight 41 receives the driving voltage VLED through an anode of the R light emitting diode RLED1, the G backlight 42 receives the driving voltage VLED through an anode of the G light emitting diode GLED1, and the B backlight 43 receives the driving voltage VLED through anodes of both B light emitting diodes BLED1 and BLED2.

The brightness adjuster includes: a first variable resistor $V_{RR}$ connected between a cathode of the R light emitting diode RLED2 of the R backlight 41 and ground to adjust the brightness of the red light emitted from the R backlight 41; a second variable resistor $V_{GR}$ connected between a cathode of the G light emitting diode GLED 1 of the G backlight 42 and ground to adjust the brightness of the green light emitted from the G backlight 42; and a third variable resistor $V_{BR}$ connected between cathodes of both B light emitting diodes BLED1 and BLED2 of the B backlight 43 and ground to adjust the brightness of the blue light emitted from the B backlight 43.

In the field sequential LCD, the driving voltage generator 51 supplies the same driving voltage (e.g., 4V) to the R, G and B backlights 41, 42 and 43, respectively, even though the light emitting diodes RLED, GLED and BLED of the R, G and B backlights 41, 42 and 43, respectively, have different forward driving voltages Vf. For example, the R light emitting diode RLED requires a forward driving voltage RVf of 2.0V, the G light emitting diode GLED requires a forward driving voltage GVf of 3.0V, and the B light emitting diode BLED requires a forward driving voltage BVf of 3.3V. Because the same driving voltage VLED of 4V is applied to each of the R, G and B backlights 41, 42 and 43, respectively, of the field sequential LCD, the brightness adjusters VRR, VGR and VBR are employed to supply the forward driving voltages RVf, GVf and BVf, respectively, of 2.0V, 3.0V and 3.3V, respectively, to the R, G and B light emitting diodes RLED, GLED, and BLED, respectively, thereby adjusting the brightness of the lights emitted from the R, G and B backlights 41, 42 and 43, respectively.

In the meantime, the light emitting diode LED has a non-variable forward current If, but a forward voltage Vf that varies according to temperature, as can be seen in the table below.

TABLE 1

| | Temperature [° C.] | Brightness [cd/m$^2$] | Driving current [mA] | Driving voltage [V] |
|---|---|---|---|---|
| Red light emitting diode | −20~−5 | 20 | 32.5 | 2.2 |
| | −5~25 | 20 | 32.5 | 2.0 |
| Green light emitting diode | −20~−5 | 45 | 37.5 | 3.1 |
| | −5~25 | 45 | 37.5 | 3.0 |
| Blue light emitting diode | −20~−5 | 15 | 40 | 3.3 |
| | −5~25 | 15 | 40 | 3.25 |

As shown in Table 1, for each light emitting diode, the driving voltage Vf required to maintain constant brightness varies when the temperature is lowered, e.g., from 15° C. to −10° C. However, the driving current If required to maintain constant brightness is constant regardless of temperature. Therefore, the brightness adjusters VRR, VGR and VBR are employed to supply the forward driving voltages RVf, GVf and BVf, respectively, corresponding to the temperature change of the R, G and B light emitting diodes RLED, GLED and BLED, respectively, thereby controlling the driving voltage Vf of each light emitting diode, and thus adjusting the brightness of the lights emitted from the R, G and B backlights 41, 42 and 43, respectively. In this regard, the values (brightness, driving current, driving voltage, etc.) shown in Table 1 may vary according to size, type and connection type of the light emitting diodes.

Figure 3:
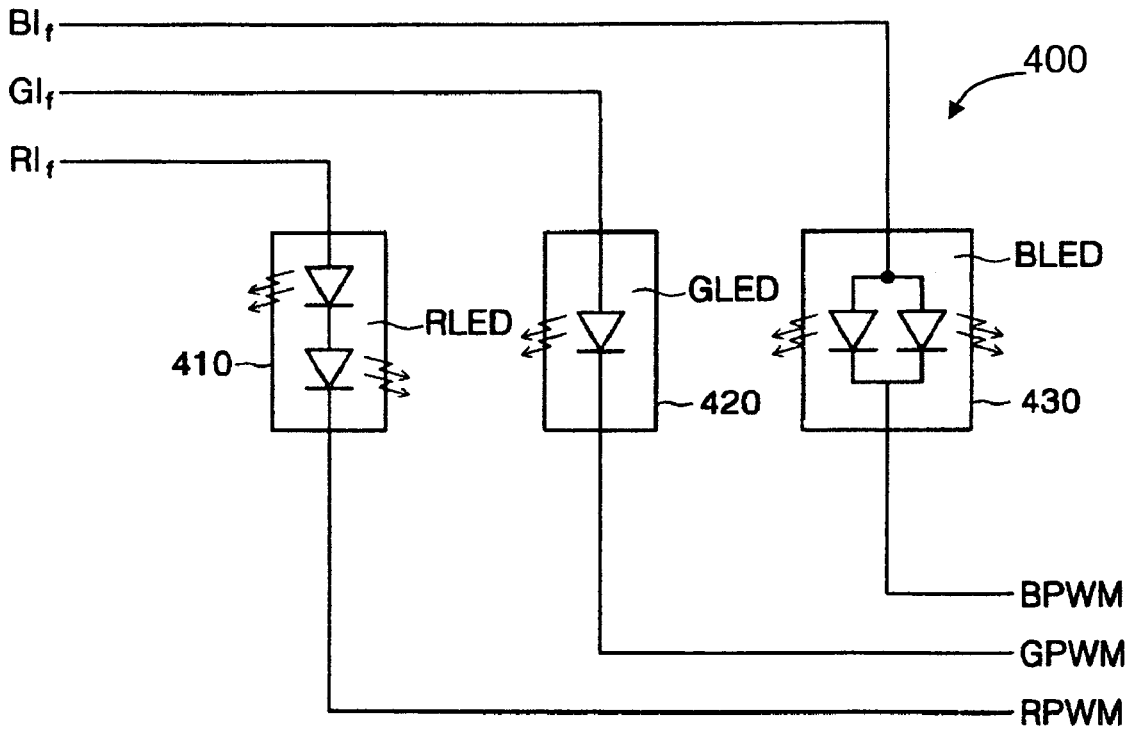
FIG. 3 is a block diagram of a backlight driver circuit employed in a field sequential LCD according to an embodiment of the present invention.

FIG. 3 is a block diagram of a backlight unit employed in a field sequential LCD according to an embodiment of the present invention.

Referring to FIG. 3, the backlight driver circuit according to an embodiment of the present invention sequentially generates forward driving currents RIf, GIf and BIf corresponding to R, G and B light emitting diodes RLED, GLED and BLED, respectively, contained in the backlight unit 400. Then, the R, G and B light emitting diodes RLED, GLED and BLED, respectively, sequentially emit light based on the forward driving currents RIf, GIf and BIf, respectively, thereby representing a color of controlled brightness. Furthermore, different pulse width modulation (PWM) values RPWM, GPWM and BPWM corresponding to the R, G and B light emitting diodes RLED, GLED and BLED, respectively, are adjusted to optimize the white balance of the represented color. In this regard, the PWM values are different for each of the R, G and B light emitting diodes RLED, GLED, and BLED, respectively.

For example, it is assumed that one frame is divided into three sub-frames and the R, G and B light emitting diodes RLED, GLED and BLED emit light in a sequence corresponding to the respective sub-frames. In this regard, in the first sub-frame, the forward driving current RIf corresponding to the R light emitting diode RLED is provided to cause the R light emitting diode RLED to emit light. In the second sub-frame, the forward driving current GIf corresponding to the G light emitting diode GLED is provided to cause the G light emitting diode GLED to emit light. In the third sub-frame, the forward driving current BIf corresponding to the B light emitting diode BLED is provided to cause the B light emitting diode BLED to emit light.

When the driving current RIf corresponding to the R light emitting diode RLED is generated in the first sub-frame, the PWM value (RPWM) corresponding to the R light emitting diode RLED is provided to adjust the chromaticity of the red color. When the driving current GIf corresponding to the G light emitting diode GLED is generated in the second sub-frame, the PWM value (GPWM) corresponding to the G light emitting diode GLED is provided to adjust the chromaticity of the green color. When the driving current BIf corresponding to the B light emitting diode BLED is generated in the third sub-frame, the PWM value (BPWM) corresponding to the B light emitting diode BLED is provided to adjust the chromaticity of the blue color.

Thus, the corresponding forward driving currents RIf, GIf and BIf are supplied to the R, G and B light emitting diodes RLED, GLED and BLED, respectively, so as to represent the red, green and blue colors. Further, the corresponding PWM values RPWM, GPWM and BPWM are provided for the R, G and B light emitting diodes RLED, GLED and BLED, respectively, which emit light based on each forward driving current, thereby controlling white balance. Hence, colors are displayed at a predetermined brightness with optimum chromaticity.

Figure 4:
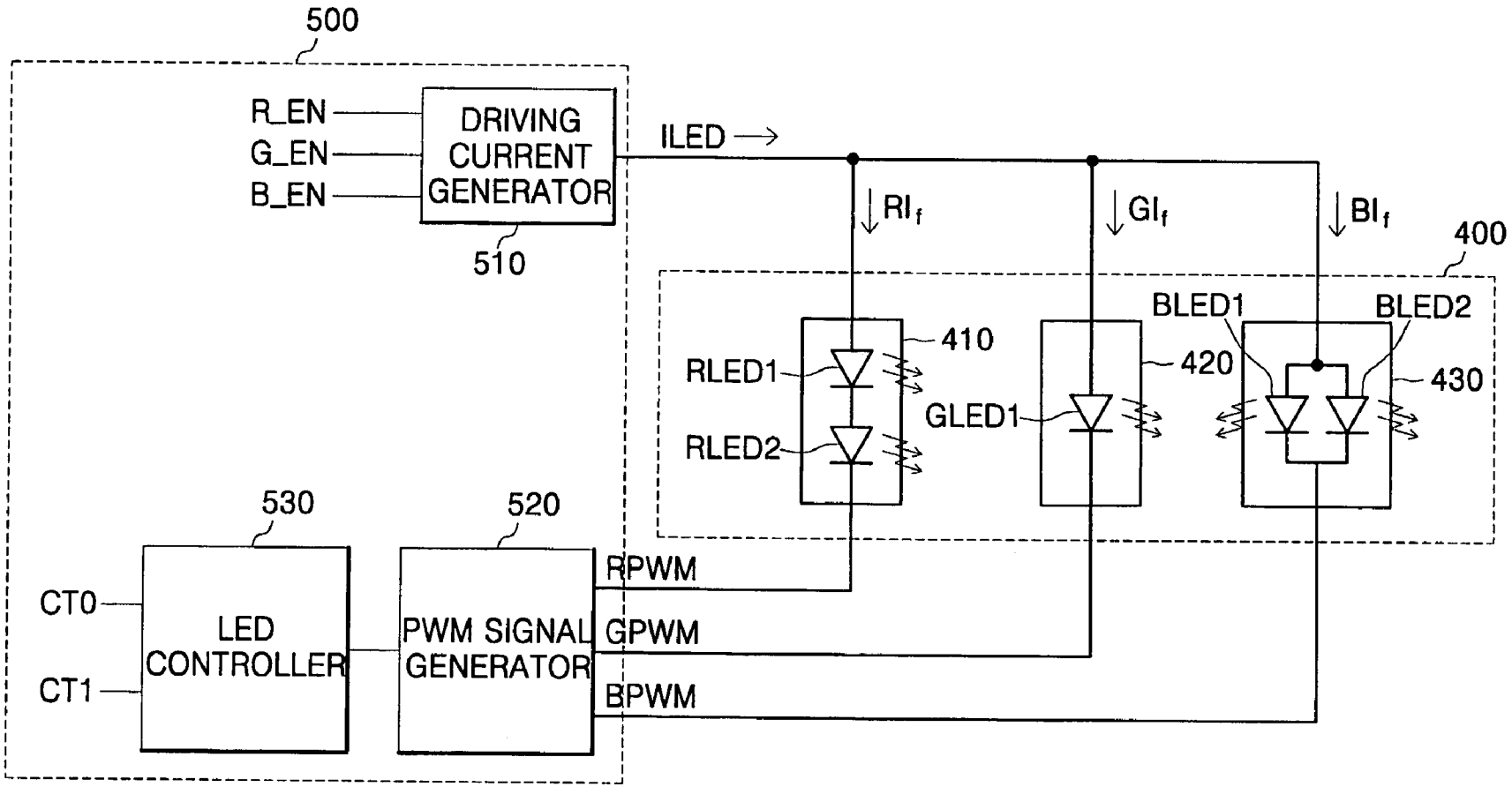
FIG. 4 is a detailed block diagram of the backlight driver circuit employed in the field sequential LCD according to an embodiment of the present invention.

FIG. 4 is a detailed block diagram of the backlight driver circuit employed in the field sequential LCD according to an embodiment of the present invention.

Referring to FIG. 4, the backlight driver circuit of the sequential LCD according to an embodiment of the present invention includes a backlight unit 400 which emits red, green, and blue lights, and a backlight driver 500 which drives the backlight unit 400.

The backlight unit 400 includes an R backlight 410 which emits red light, a G backlight 420 which emits green light, and a B backlight 430 which emits blue light.

The backlight driver 500 includes a driving current generator 510 which supplies a driving current ILED to the backlight unit 400, an LED controller 530 which controls the backlight unit 400 to emit light on the basis of a first control signal CT0 and a second control signal CT1, and a PWM signal generator 520 which supplies a PWM signal to the backlight unit 400 in response to an output signal of the LED controller 530.

The R backlight 410 includes two R light emitting diodes RLED1 and RLED2 connected in series with each other, and receives the forward driving current RIf from the driving current generator 510 so as to drive the R light emitting diodes RLED1 and RLED2.

The G backlight 420 includes one G light emitting diode GLED1, and receives the forward driving current GIf from the driving current generator 510 so as to drive the G light emitting diode GLED1.

The B backlight 430 includes two B light emitting diodes BLED1 and BLED2 connected in parallel with each other, and receives the forward driving current BIf from the driving current generator 510 so as to drive the B light emitting diodes BLED1 and BLED2.

In this embodiment, the backlight unit 400 includes the R, G and B light emitting diodes, but the present invention is not limited to this form of backlight unit 400. Alternatively, the backlight unit 400 may include a white (W) light emitting diode in addition to the R, G and B light emitting diodes. Furthermore, in the present embodiment, each of the R, G and B backlights includes one or two light emitting diodes, but the present invention is not limited to these types of backlight. Alternatively, each of the R, G and B backlights may include two or more light emitting diodes.

The driving current generator 510 sequentially generates the forward driving currents RIf, GIf and BIf suitable for the R, G and B backlights 410, 420 and 430, respectively, of the backlight unit 400. In this regard, the driving current generator 510 includes a register for storing data corresponding to the forward driving currents RIf, GIf and BIf of the R, G and B backlights 410, 420 and 430, respectively.

Thus, the driving current generator 510 outputs the driving current ILED for driving the light emitting diode, i.e., generates the driving current RIf suitable for the R light emitting diodes RLED 1 and RLED2, in response to an R enable signal R_EN in an R sub-frame for driving the R light emitting diodes RLED1 and RLED2; generates the driving current GIf suitable for the G light emitting diode GLED 1 in response to a G enable signal G_EN in a G sub-frame for driving the G light emitting diode GLED 1; and generates the driving current BIf 11 suitable for the B light emitting diodes BLED 1 and BLED2 in response to a B enable signal B_EN in a B sub-frame for driving the B light emitting diodes BLED1 and BLED2.

In the latter regard, the driving currents RIf, GIf and BIf supplied to the R, G and B backlights either are all different or only two of them are the same and the third is different.

The LED controller 530 outputs a signal for driving a corresponding one of the R, G and B backlights in one of a plurality of sub-frames forming one frame on the basis of the first control signal CT0 and the second control signal CT1. Concerning the first control signal CT0 and the second control signal CT1 for controlling the R, G and B backlights to emit light in sequence, the total number of possible combinations of the first control signal CT0 and the second control signal CT1, each having a low level '0' and a high level '1', is four, i.e., '00', '01', '10'and '11'. For example, when the control signal is '00', the LED controller 530 outputs a signal for activating a previous state. Likewise, the LED controller 530 outputs signals for driving the R, G and B light emitting diodes when the control signal is '10', '01' and '11', respectively.

The PWM signal generator 520 generates the PWM signals RPWM, GPWM and BPWM corresponding to the R, G and B backlights 410, 420 and 430, respectively, according to the output signals of the LED controller 530. The PWM signal generator 520 includes a register for storing data corresponding to the PWM signal of the R, G and B backlights 410, 420 and 430, respectively. Thus, the PWM generator 520 outputs the PWM signal RPWM to the R backlight 410 in the R sub-frame so as to adjust the pulse width of the driving current RIf flowing in the R backlight 410, outputs the PWM signal GPWM to the G backlight 420 in the G sub-frame so as to adjust the pulse width of the driving current GIf flowing in the G backlight 420, and outputs the PWM signal BPWM to the B backlight 430 in the B sub-frame so as to adjust the pulse width of the driving current BIf flowing in the B backlight 430.

As described above, the backlight driver 500 of the field sequential LCD, according to an embodiment of the present invention, includes: the driving current generator 510 for generating the different driving currents RIf, GIf and BIf to flow in the R, G and B backlights 410, 420 and 430, respectively, during each sub-frame so as to achieve a desired brightness; and the PWM signal generator 520 for adjusting the pulse width of the driving current flowing in each backlight so as to control the white balance. Hence, colors are displayed at a predetermined brightness with optimum chromaticity.

Operation of the backlight driver circuit with this configuration will be described below with reference to FIG. 5.

Figure 5:
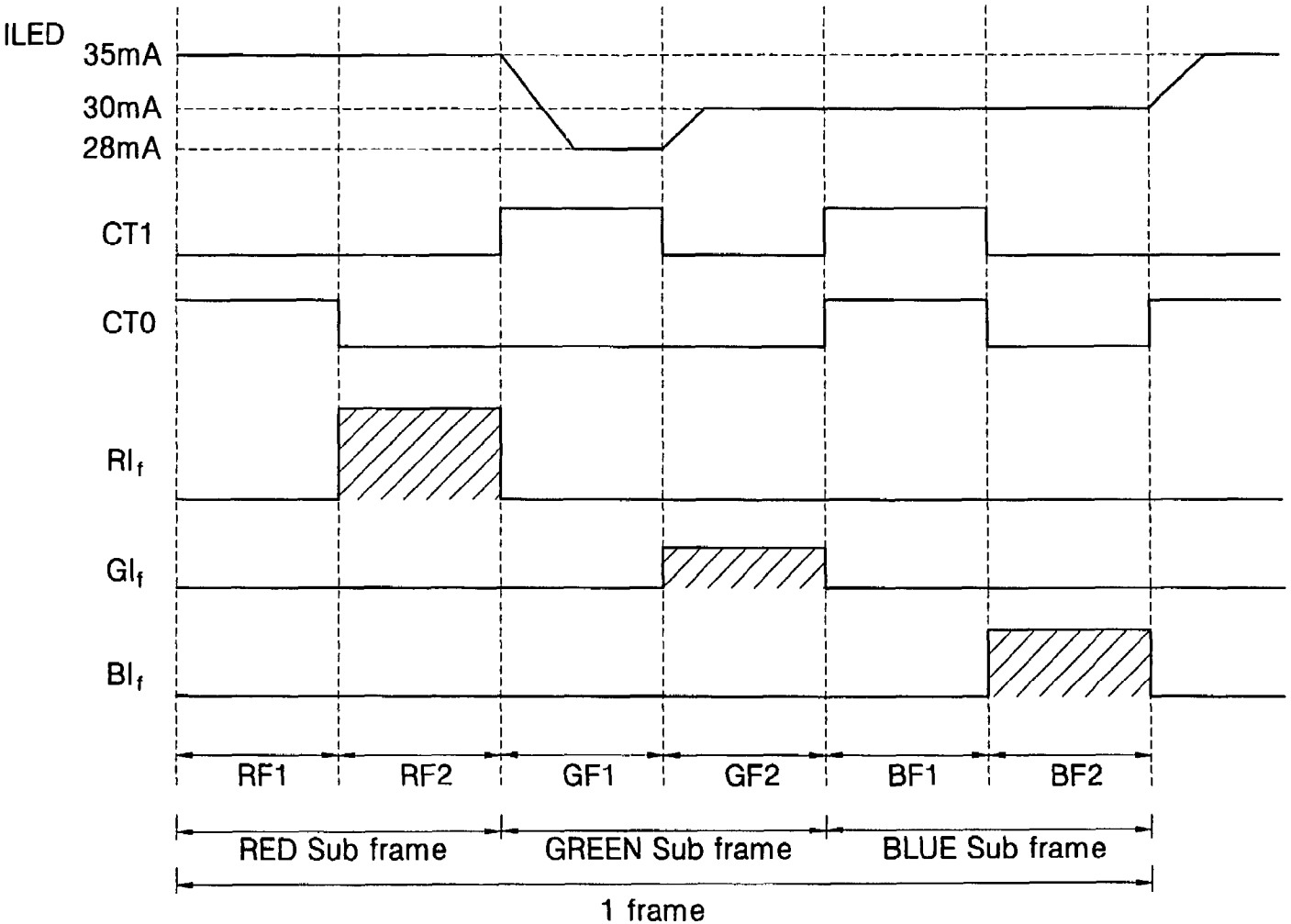
FIG. 5 is a signal timing diagram relative to operation of the backlight driver circuit according to an embodiment of the present invention.

FIG. 5 is a signal timing diagram relative to operation of the backlight driver circuit according to an embodiment of the present invention.

According to an embodiment of the present invention, one frame is divided into three sub-frames. For example, it is assumed that one frame is divided into the R sub-frame for driving the R backlight, the G sub-frame for driving the G backlight, and the B sub-frame for driving the B backlight, and that the R, G and B backlights are sequentially driven in each frame.

Referring to FIG. 5, the driving current generator 510 supplies a driving current, e.g., a forward driving current ILED of 35 mA, to the R backlight 410 in the R sub-frame. At this 11 point, the first control signal CT0 having a high level and the second control signal CT1 having a low level (i.e., '10', refer to FIG. 5) are transmitted to the LED controller 530 so as to cause the R backlight 410 to emit light. Then, the LED controller 530 supplies an output signal for driving the R backlight 410 of the backlight unit 400 to the PWM signal generator 520. Then, the PWM signal generator 520 generates the PWM signal RPWM for driving the R backlight 410 according to the output signal of the LED controller 530. Thus, the R backlight 410 receives the forward current ILED applied to the R light emitting diodes RLED1 and RLED2 and the driving current RIf corresponding to the PWM signal RPWM, as shown in FIG. 5, thereby emitting red light having predetermined chromaticity and brightness. In this embodiment, the R backlight 410 includes two R light emitting diodes RLED1 and RLED2 connected in series with each other, and the driving current generator 510 supplies a current of 35 mA to the R backlight 410. Alternatively, the R backlight 410 may include two R light emitting diodes RLED1 and RLED2 connected in parallel with each other, in which case the driving current generator 510 supplies a current of 70 mA to the R backlight 410.

Next, the driving current generator 510 supplies a driving current, e.g., a forward driving current ILED of 28 mA, to the G backlight 420 in the G sub-frame. At this point, the first control signal CT0 having a low level and the second control signal CT1 having a high level (i.e., '01', refer to FIG. 5) are transmitted to the LED controller 530 so as to cause the G backlight 420 to emit light. Then, the LED controller 530 supplies an output signal for driving the G backlight 420 of the backlight unit 400 to the PWM signal generator 520. Then, the PWM signal generator 520 generates the PWM signal GPWM for driving the G backlight 420 according to the output signal of the LED controller 530. Thus, the G backlight 420 receives the forward current ILED applied to the G light emitting diode GLED1 and the driving current GIf corresponding to the PWM signal GPWM as shown in FIG. 5, thereby emitting green light having predetermined chromaticity and brightness.

Lastly, the driving current generator 510 supplies a driving current, e.g., a forward driving current ILED of 30 mA, to the B backlight 430 in the B sub-frame. At this point, the first control signal CT0 having a high level and the second control signal CT1 having a high level (i.e., '11', refer to FIG. 5) are transmitted to the LED controller 530 so as to cause the B backlight 430 to emit light. Then, the LED controller 530 supplies an output signal for driving the B backlight 430 of the backlight unit 400 to the PWM signal generator 520. The PWM signal generator 520 generates the PWM signal BPWM for driving the B backlight 430 according to the output signal of the LED controller 530. Thus, the B backlight 430 receives the forward current ILED applied to the B light emitting diodes BLED1 and BLED2 and the driving current BIf corresponding to the PWM signal BPWM, as shown in FIG. 5, thereby emitting blue light having predetermined chromaticity and brightness.

Therefore, in the field sequential LCD according to an embodiment of the present invention, the backlight driver 500 supplies both the driving current ILED generated by the driving current generator 510, and the forward driving currents RIf, GIf and BIf corresponding to the PWM signals RPWM, GPWM and BPWM, respectively, transmitted by the PWM signal generator 520 to the R, G and B backlights 410, 420 and 430, respectively, thereby driving the R, G and B backlights 410, 420 and 430, respectively, to emit light having predetermined brightness and chromaticity.

In the foregoing embodiment, one frame is divided into three sub-frames, and the R, G and B light emitting diodes are driven in sequence, one per sub-frame. Alternatively, one frame may be divided into four or more sub-frames, in which case the R, G and B light emitting diodes may be sequentially driven in three of the four sub-frames, and at least one of the R, G and B light emitting diodes is driven in the remaining sub-frame. Furthermore, R, G, B, and W light emitting diodes may be driven in four sub-frames, one per sub-frame.

In the foregoing embodiment, the R, G and B light emitting diodes RLED, GLED and BLED, respectively, are driven to emit light in respective sub-frames of one frame in a driving order of R, G, and B. Alternatively, the driving order for the light emitting diodes may be changed to optimize brightness and chromaticity. In the meantime, referring to FIG. 5, one sub-frame is further divided into two sections. In this case, for example, the forward driving currents suitable for the R, G and B light emitting diodes are selected in the respective first sections RF1, GF1 and BF1, and then the selected forward driving currents are generated in the respective second sections RF2, GF2 and BF2 to drive the respective light emitting diodes.

As described above, the present invention provides a field sequential LCD having a backlight driver circuit in which data corresponding to forward driving currents suitable for respective R, G and B light emitting diodes is stored in a register, and the forward driving current corresponding to one of the R, G and B light emitting diodes is generated in each sub-frame, thereby emitting light with optimum brightness.

Furthermore, data corresponding to PWM values suitable for the R, G and B light 11 emitting diodes are stored in another register, and a PWM signal is generated in correspondence to one of the R, G and B light emitting diodes in each sub-frame, thereby emitting light with optimum chromaticity, and thus enhancing power efficiency.

While the present invention has been described with reference to a particular embodiment thereof, it will be understood by those skilled in the art that various modifications can be made therein without departing from the spirit and scope of the present invention as defined by the appended claims.

What is claimed is:

1. A liquid crystal display (LCD) device, comprising:

an LCD panel having a plurality of pixels formed in a region in which a plurality of scan lines intersect a plurality of data lines, the LCD panel displaying a predetermined image;

a scan driver for supplying a scan signal to the plurality of scan lines so as to select pixels;

a source driver for supplying a data signal to the pixels selected by the scan signal through the plurality of data lines;

a backlight unit having R, G and B backlights for sequentially emitting light toward the LCD panel in one frame divided into at least two sub-frames;

a backlight driver for supplying R, G and B driving currents and R, G and B pulse width modulation (PWM) signals to the backlight unit so as to selectively cause generation of a previous state, activation of the R backlight, activation of the G backlight and activation of the B backlight, and controlling brightness and chromaticity of the R, G and B backlights; and a timing controller for controlling the scan driver, the source driver and the backlight driver.

2. The LCD according to claim 1, wherein the backlight driver comprises:

a driving current generator for supplying the R, G and B driving currents to the R, G and B backlights, respectively, and for causing the R, G and B backlights to emit light with predetermined brightness; and a PWM signal generator for supplying the R, G and B PWM signals to the R, G and B backlights, respectively, and for adjusting the chromaticity of the light emitted from each of the R, G and B backlights.

3. The LCD according to claim 2, wherein the driving current generator comprises a register for storing R, G and B data corresponding to the R, G and B driving currents, respectively.

4. The LCD according to claim 2, wherein the PWM signal generator comprises a register for storing R, G and B data corresponding to the R, G and B PWM signals, respectively.

5. The LCD according to claim 4, wherein the R, G and B PWM signals are used in adjusting the chromaticity of the R, G and B backlights so as to adjust a white balance.

6. The LCD according to claim 2, wherein the backlight driver further comprises a light emitting diode (LED) controller for supplying a control signal to the PWM signal generator so as to cause at least one of the R, G and B backlights to emit light in each sub-frame.

7. The LCD according to claim 6, wherein the R backlight comprises two red light emitting diodes connected in series with each other, the G backlight comprises one green light emitting diode, and the B backlight comprises two blue light emitting diodes connected in parallel with each other.

8. A backlight driver circuit for emitting light toward a liquid crystal display (LCD) panel so as to display an image on the basis of a scan signal of a scan driver and a data signal of a source driver, the backlight driver circuit comprising:

a backlight unit having R, G and B backlights for sequentially emitting light toward the LCD panel in one frame divided into at least two sub-frames;

a driving current generator for supplying R, G and B driving currents to the R, G and B backlights, respectively, so as to cause the R, G and B backlights, respectively, to emit light with predetermined brightness;

a pulse width modulation (PWM) signal generator for supplying R, G and B PWM signals to the R, G and B backlights, respectively, to adjust chromaticity of the light emitted from the R, G and B backlights, respectively; and a light emitting diode (LED) controller for supplying a control signal to the PWM signal generator so as to selectively cause generation of a previous state, activation of the R backlight to emit light in a first sub-frame, activation of the G backlight to emit light in a second sub-frame, and activation of the B backlight to emit light in a third sub-frame.

9. The backlight driver circuit according to claim 8, wherein the driving current generator comprises a register for storing R, G and B data corresponding to the R, G and B driving currents, respectively.

10. The backlight driver circuit according to claim 8, wherein the PWM signal generator comprises a register for storing R, G and B data corresponding to the R, G and B PWM signals, respectively.

11. The backlight driver circuit according to claim 10, wherein the R, G and B PWM signals are used in adjusting the chromaticity of the R, G and B backlights, respectively, so as to adjust a white balance.

12. The backlight driver circuit according to claim 8, wherein the R backlight comprises two red light emitting diodes connected in series with each other, the G backlight comprises one green light emitting diode, and the B backlight comprises two blue light emitting diodes connected in parallel with each other.

13. The backlight driver circuit according to claim 8, wherein the control signal is a two-digit binary signal having four states, each corresponding to a respective one of the generation of a previous state, the activation of the R backlight, the activation of the G backlight, and the activation of the B backlight.

14. A liquid crystal display (LCD) device, comprising:

an LCD panel having a plurality of pixels formed in a region in which a plurality of scan lines intersect a plurality of data lines, the LCD panel displaying a predetermined image;

a scan driver for supplying a scan signal to the plurality of scan lines so as to select pixels;

a source driver for supplying a data signal to the pixels selected by the scan signal through the plurality of data lines;

a backlight unit for having R, G and B backlights for sequentially emitting light toward the LCD panel in one frame divided into at least two sub-frames; and a backlight driver for supplying R, G and B driving currents and R, G and B pulse width modulation (PWM) signals to the backlight unit, and controlling brightness and chromaticity of the R, G and B backlights;

wherein the backlight driver comprises:

a PWM signal generator for supplying the R, G and B PWM signals to the R, G and B backlights, respectively, and for adjusting the chromaticity of the light emitted from each of the R, G and B backlights; and a light emitting diode (LED) controller for supplying a control signal to the PWM signal generator so as to selectively cause generation of a previous state, activation of the R backlight to emit light in a first sub-frame, activation of the G backlight to emit light in a second sub-frame, and activation of the B backlight to emit light in a third sub-frame.

15. The LCD device according to claim 14, wherein the backlight driver further comprises a driving current generator for supplying R, G and B driving currents to the R, G and B backlights, respectively, so as to cause the R, G and B backlights, respectively, to emit light with predetermined brightness.

16. The LCD device according to claim 15, wherein the driving current generator comprises a register for storing R, G and B data corresponding to the R, G and B driving currents, respectively.

17. The LCD device according to claim 14, wherein the PWM signal generator comprises a register for storing R, G and B data corresponding to the R, G and B PWM signals, respectively.

18. The LCD device according to claim 14, wherein the R, G and B PWM signals are used in adjusting the chromaticity of the R, G and B backlights, respectively, so as to adjust a white balance.

19. The LCD device according to claim 14, further comprising a timing controller directly connected to the scan driver, the source driver and the backlight driver for directly controlling the scan driver, the source driver and the backlight driver.

* * * * *